US012215614B2

(12) United States Patent
Gaiser

(10) Patent No.: US 12,215,614 B2
(45) Date of Patent: Feb. 4, 2025

(54) EXHAUST GAS SYSTEM FOR A HYDROGEN COMBUSTION ENGINE

(71) Applicant: Purem GmbH, Neunkirchen (DE)

(72) Inventor: Gerd Gaiser, Reutlingen (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 18/448,557

(22) Filed: Aug. 11, 2023

(65) Prior Publication Data

US 2024/0052765 A1 Feb. 15, 2024

(30) Foreign Application Priority Data

Aug. 11, 2022 (DE) ..... 10 2022 120 292.5

(51) Int. Cl.

| | |
|---|---|
| ***F01N 3/02*** | (2006.01) |
| ***F01N 3/00*** | (2006.01) |
| ***F01N 3/04*** | (2006.01) |
| ***F01N 3/20*** | (2006.01) |

(52) U.S. Cl.

CPC ..... *F01N 3/0205* (2013.01); *F01N 3/005* (2013.01); *F01N 3/043* (2013.01); *F01N 3/2013* (2013.01)

(58) Field of Classification Search

CPC ..... F01N 3/005; F01N 3/0502; F01N 3/04; F01N 3/043; F01N 3/2013; F01N 3/2033; F01N 3/2066; F01N 5/00; F01N 5/02; F01N 2240/02; F01N 2240/14; F01N 2240/16; F01N 2240/22; F01N 2570/14; F02B 43/10; Y02T 10/12; Y02T 10/40

See application file for complete search history.

(56) References Cited

U.S. PATENT DOCUMENTS

| | | | | |
|---|---|---|---|---|
| 3,808,805 | A * | 5/1974 | Miramontes | F01N 3/0205 60/309 |
| 4,409,931 | A * | 10/1983 | Lindberg | F02M 25/00 123/25 J |
| 6,804,949 | B2 * | 10/2004 | Andrews | F02B 47/02 60/272 |
| 7,370,609 | B2 * | 5/2008 | Kamio | F02D 19/081 123/3 |
| 8,910,484 | B2 * | 12/2014 | Hoffjann | F02M 25/0228 60/39.5 |
| 2015/0226100 | A1 * | 8/2015 | Bandl-Konrad | F01N 3/208 423/213.7 |

FOREIGN PATENT DOCUMENTS

| | | |
|---|---|---|
| DE | 10 2018 112 741 A1 | 12/2018 |
| DE | 10 2020 209 154 A1 | 1/2022 |
| DE | 10 2020 209 156 A1 | 1/2022 |
| KR | 10-0694492 B1 | 3/2007 |
| WO | 2004/044399 A2 | 5/2004 |

* cited by examiner

*Primary Examiner* — Dapinder Singh
(74) *Attorney, Agent, or Firm* — Walter Ottesen, P.A.

(57) ABSTRACT

An exhaust gas system for a hydrogen combustion engine including for a vehicle, the exhaust gas system including: a first engine exhaust gas cooler accommodating a flow of engine exhaust gas therethrough for dissipating heat from the engine exhaust gas; a separator being configured to separate condensate contained in the engine exhaust gas in a region of the first engine exhaust gas cooler and/or downstream of the first engine exhaust gas cooler; and, an engine exhaust gas heater being configured to warm the engine exhaust gas in a region of the separator and/or downstream of the separator.

17 Claims, 4 Drawing Sheets

EXHAUST GAS SYSTEM FOR A HYDROGEN COMBUSTION ENGINE

CROSS-REFERENCE TO RELATED APPLICATIONS

This application claims priority of German patent application no. 10 2022 120 292.5, filed Aug. 11, 2022, the entire content of which is incorporated herein by reference.

TECHNICAL FIELD

The present disclosure relates to an exhaust gas system for a hydrogen combustion engine which can be used, for example, in a vehicle as a drive unit.

BACKGROUND

In trying to make it possible for alternative energy sources to be used, in particular, for the drive of vehicles, hydrogen combustion engines operated with hydrogen and atmospheric oxygen are gaining increasingly in importance. In a hydrogen combustion engine of this type, the hydrogen which is fed into it and the atmospheric oxygen which is fed into it are burned. The engine exhaust gas which is produced during this combustion contains a considerable proportion of water vapor. Unburned hydrogen and residual air or residual atmospheric oxygen can also be contained in the engine exhaust gas.

If the engine exhaust gas which contains a high water vapor proportion is discharged to the surrounding area, in particular at comparatively low ambient temperatures, a spontaneous condensation of water and therefore the formation of mist can occur in the region of a vehicle when the engine exhaust gas comes into contact with the cold ambient air. The formation of mist of this type can firstly be considered to be unpleasant and undesired. Secondly, in particular at comparatively low ambient temperatures, the water which condenses can lead to a potentially dangerous formation of ice on the ground or on objects in the surrounding area of the vehicle. Furthermore, water vapor contained in the engine exhaust gas can lead to excessively pronounced ageing of catalytic converters contained in an exhaust gas system.

SUMMARY

It is an object of the present disclosure to provide an exhaust gas system for a hydrogen combustion engine, by way of which exhaust gas system formation of mist in the engine exhaust gas which is output to the surrounding area is substantially avoided.

According to the disclosure, this object is achieved by way of an exhaust gas system for a hydrogen combustion engine, in particular for a vehicle, including:

- a first engine exhaust gas cooling unit which can be flowed through by engine exhaust gas in order to dissipate heat from the engine exhaust gas,
- in the region of and/or downstream of the first engine exhaust gas cooling unit, a separating unit for separating condensate which is contained in the engine exhaust gas,
- in the region of and/or downstream of the separating unit, an engine exhaust gas heating unit for warming the engine exhaust gas.

In the case of the exhaust gas system constructed according to the disclosure, a part of the water or water vapor transported in the engine exhaust gas first of all precipitates out of the engine exhaust gas as a result of the cooling of the engine exhaust gas and therefore the lowering of the temperature of the engine exhaust gas below the dew point, and can be caught or collected as condensate, in particular, in the separating unit. In the case of the heating, then taking place in the engine exhaust gas heating unit, of the engine exhaust gas which has had water or water vapor removed, a change in the quantity of the water vapor still contained in the engine exhaust gas is admittedly not brought about. On account of the temperature increase, however, the relative humidity in the engine exhaust gas drops considerably. If the engine exhaust gas which has had water vapor removed is then output to the surrounding area at the elevated temperature, a spontaneous condensation or formation of mist is avoided. Even before its temperature drops again considerably, the engine exhaust gas can mix with the ambient air to a sufficient extent, with the result that a pronounced formation of mist can be avoided locally in the region, in which the engine exhaust gas exits from the exhaust gas system, as a result of the dilution which occurs in this way.

For efficient cooling of the engine exhaust gas, the first engine exhaust gas cooling unit can include a first heat exchanger for transferring heat from the engine exhaust gas to a cooling medium, preferably cooling liquid or cooling gas.

For efficient heating of the engine exhaust gas which has had water vapor removed, the engine exhaust gas heating unit can likewise include a second heat exchanger for transferring heat from a heating medium, preferably heating liquid or heating gas, to the engine exhaust gas, and/or can include at least one electrically excitable heater.

In order for it to be possible for the heat transported in the engine exhaust gas to be used for energy-efficient operation of the exhaust gas system, it is proposed that a heat transfer medium which flows through the first heat exchanger and the second heat exchanger provides the cooling medium and the heating medium. This heat transfer medium can therefore transfer heat from the engine exhaust gas which flows in a further upstream part of the exhaust gas system to the engine exhaust gas which flows in a further downstream part of the exhaust gas system.

In the case of one alternative configuration variant which likewise uses the heat transported in the engine exhaust gas, a heat exchanger unit which provides the first heat exchanger and the second heat exchanger can be provided, the heat exchanger unit including an upstream heat exchanger region which can be flowed through by the engine exhaust gas and, downstream of the upstream heat exchanger region, a downstream heat exchanger region which is in heat transfer interaction with the upstream heat exchanger region. As a result of the heat transfer interaction of the two heat exchanger regions, a heat transfer which is direct, does not require a liquid or gaseous heat transfer medium, and is therefore highly efficient is achieved.

In order for it to be possible for the water which condenses after cooling of the engine exhaust gas to be discharged even in the case of this substantially direct heat transfer, it is proposed that the separating unit is arranged downstream of the upstream heat exchanger region and upstream of the downstream heat exchanger region.

For a structural integration of different system regions of the exhaust gas system and therefore a compact construction, it is proposed, furthermore, that a second engine exhaust gas cooling unit for dissipating heat from the engine exhaust gas is provided downstream of the upstream heat exchanger region and/or at a downstream end of the upstream heat exchanger region and upstream of the downstream heat exchanger region and/or at an upstream end of the downstream heat exchanger region. As a result of the provision of a second engine exhaust gas cooling unit of this type, the engine exhaust gas is cooled further upstream of the downstream heat exchanger region, in addition to the cooling which already takes place in the upstream heat exchanger region, and therefore the condensing of water is assisted.

Here, the second engine exhaust gas cooling unit can include a third heat exchanger for transferring heat from the engine exhaust gas to a cooling medium, preferably cooling liquid or cooling gas.

The heat exchanger unit can include a heat exchanger unit housing, the upstream heat exchanger region and the downstream heat exchanger region being provided in the heat exchanger unit housing. Here, furthermore, the third heat exchanger can be arranged substantially in the heat exchanger unit housing, and/or the heat exchanger unit housing can be arranged in a surrounding manner on an outer side.

For an efficient transfer of heat for engine exhaust gas which flows in different parts of the exhaust gas system, the heat exchanger unit can include a countercurrent heat exchanger or a cross-flow heat exchanger.

In order to introduce engine exhaust gas into the first engine exhaust gas cooling unit, an engine exhaust gas line which leads to this first engine exhaust gas cooling unit can be provided.

Furthermore, an engine exhaust gas outlet line which leads away from the engine exhaust gas heating unit can be provided in order to output engine exhaust gas which has had water or water vapor removed.

In order to lower the hydrogen proportion contained in the engine exhaust gas, at least one oxidation unit, preferably an oxidation catalytic converter and/or a burner, can be provided for oxidizing hydrogen contained in the engine exhaust gas. Since relatively great quantities of nitrogen oxide can also be contained in the engine exhaust gas, in particular, depending on the operating type of a hydrogen combustion engine, it is proposed, furthermore, that the exhaust gas system has at least one catalytic converter unit, preferably an SCR catalytic converter, for decreasing the nitrogen oxide proportion contained in the engine exhaust gas.

In order to load catalytic converters provided in the exhaust gas system with an engine exhaust gas which contains as low a water vapor proportion as possible, it is proposed that at least one oxidation unit and/or at least one catalytic converter unit are/is arranged in the engine exhaust gas outlet line, that is, downstream of the first engine exhaust gas cooling unit and the engine exhaust gas heating unit.

In order to decrease the nitrogen oxide proportion in the engine exhaust gas, a reduction reaction, for example a selective catalytic reduction (SCR), can be carried out. At least one reactant dispensing arrangement can be provided to dispense the reactant required for this purpose into the engine exhaust gas.

Here, at least one reactant dispensing arrangement is preferably arranged upstream of at least one catalytic converter unit.

In order to prevent the transport of noise produced during combustion operation of a hydrogen combustion engine via the engine exhaust gas to the surrounding area as efficiently as possible, a muffler can be arranged in an engine exhaust gas outlet line which leads away from the engine exhaust gas heating unit.

Furthermore, the disclosure relates to a drive system for a vehicle, including a hydrogen combustion engine and an exhaust gas system which is constructed according to the disclosure and is assigned to the hydrogen combustion engine.

Furthermore, the disclosure relates to a method for operating a drive system, including a hydrogen combustion engine, for a vehicle, in particular with the construction according to the disclosure, in the case of which method engine exhaust gas which is output by the hydrogen combustion engine is cooled in order to condense water, and the engine exhaust gas which has had water vapor removed after the condensing of water is heated.

BRIEF DESCRIPTION OF DRAWINGS

The invention will now be described with reference to the drawings wherein:

FIG. 6 shows a further illustration, corresponding to FIG. 1, of an alternative embodiment of a drive system for a vehicle; and.

DETAILED DESCRIPTION

Figure 1:
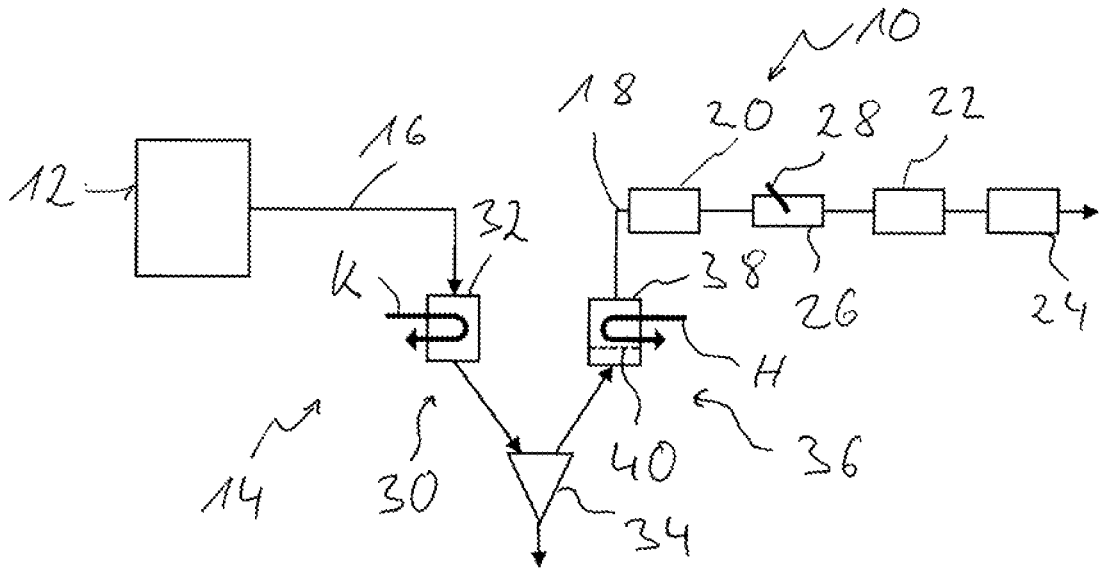
FIG. 1 shows an outline illustration of a drive system, including a hydrogen combustion engine and an exhaust gas system for the hydrogen combustion engine, for a vehicle.

In FIG. 1, a drive system for a vehicle is denoted in general by 10. As drive unit, the drive system 10 includes a hydrogen combustion engine 12, to which hydrogen, or a hydrogen-containing gas, and oxygen, or an oxygen-containing gas, for example air, are fed. The hydrogen and the oxygen are burned in the hydrogen combustion engine 12. The engine exhaust gas which arises during this combustion is discharged to the surrounding area via an engine exhaust gas line 16, receiving an engine exhaust gas from the hydrogen combustion engine 12, and an exhaust gas system 14, including an engine exhaust gas outlet line 18, for the hydrogen combustion engine 12.

If a hydrogen combustion engine 12 of this type is operated in an operating type with a lambda value in the region of 1, its combustion characteristic corresponds approximately to that of a gasoline internal combustion engine. Therefore, in the case of an operating type like this, a catalytic converter can be provided for exhaust gas purification in the engine exhaust gas outlet line 18, which catalytic converter corresponds to a 3-way catalytic converter used in conjunction with a gasoline internal combustion engine.

In the case of hydrogen combustion engines, operation with a lambda value greater than 1 is preferred on account of a higher degree of efficiency, that is, operation with an excess of oxygen. In the case of the combustion with an excess of air, the engine exhaust gas contains not only traces of unburned hydrogen, but also nitrogen oxides. The concentration of the hydrogen which is still contained in the engine exhaust gas can be so high here that an output to the surrounding area is not permissible. Therefore, a catalytic converter unit which forms an embodiment of an oxidation unit 20, that is, an oxidation catalytic converter, can be arranged in the engine exhaust gas outlet line 18, in which catalytic converter unit the residual hydrogen contained in the engine exhaust gas is oxidized with oxygen fed into the engine exhaust gas outlet line 18 via a feed line. Via this feed line, for example, air can be introduced into the engine exhaust gas outlet line 18.

In order to decrease the nitrogen oxide proportion in the engine exhaust gas, a catalytic converter unit 22 which is configured, for example, in the form of an SCR catalytic converter is provided in the engine exhaust gas outlet line 18. The reactant which is required to carry out a reaction of this type can be injected in a mixing section 26 arranged upstream of the catalytic converter unit 22 via a reactant dispensing unit 28 which is generally called an injector. The reactant which is generally injected as a spray mist into the engine exhaust gas, for example a mixture of urea and water, is mixed with the engine exhaust gas. The ammonia which is formed during this thorough mixing from the urea/water mixture leads to NOx reduction in the reduction reaction which proceeds in the catalytic converter unit 22. In order to remove ammonia from the engine exhaust gas which is possibly still present after the reduction reaction in the engine exhaust gas, what is known as a clean-up catalytic converter for reducing the still existing ammonia can be provided downstream of the catalytic converter unit 22. As an alternative, the NOx reduction can also be carried out with the use of hydrogen as reducing agent.

In order as far as possible to suppress the emission of noise arising during the operation of the hydrogen combustion engine 12 via the exhaust gas system 14 or the engine exhaust gas which flows through the latter, a muffler 24 is arranged in the engine exhaust gas outlet line 18, for example, downstream of the catalytic converter unit 22. As in the case of mufflers which are assigned to gasoline or diesel internal combustion engines, the muffler 24 can include one or more chambers which are connected to one another and can be flowed through by the engine exhaust gas and/or one or more resonator chambers.

The engine exhaust gas line 16 leads to a first engine exhaust gas cooling unit 30. The first engine exhaust gas cooling unit 30 can include a first heat exchanger 32, in which the engine exhaust gas which flows through the first engine exhaust gas line 16 transfers heat to a liquid or gaseous cooling medium K and is cooled as a result. As a result of this cooling, a part of the water or water vapor contained in the engine exhaust gas condenses in a separating unit 34 following the first engine exhaust gas cooling unit 30, and can be dispensed in liquid form to the surrounding area.

In an engine exhaust gas heating unit 36 which follows the separating unit 34 downstream, the engine exhaust gas which has had water vapor removed is heated again. This heating can take place by virtue of the fact that heat is transmitted by way of a heating medium H to the engine exhaust gas which flows through the engine exhaust gas heating unit 36, if the engine exhaust gas heating unit 36 is configured as a second heat exchanger 38. As an alternative or in addition, the engine exhaust gas heating unit 36 can include an electrically excitable heater 40 which is flowed through by the engine exhaust gas which has had water vapor removed, and transfers heat to the latter in the process.

In the drive system 10 which is shown in FIG. 1, a part, in particular a relatively great part, of the water vapor contained therein is first of all removed by cooling from the engine exhaust gas which is output via the engine exhaust gas line 16. On account of its comparatively low temperature, the engine exhaust gas which has had water vapor removed has a high relative humidity which can lie close to 100%. The relative humidity of the engine exhaust gas is lowered by way of the heating of this engine exhaust gas which has had water vapor removed but nevertheless has a high relative humidity, with the result that the engine exhaust gas which is discharged to the surrounding area via the engine exhaust gas outlet line 18 has a relative humidity which lies considerably below 100%. Even if this engine exhaust gas which is then discharged to the surrounding area comes into contact with comparatively cold ambient air or comparatively cold objects which are situated in the surrounding area of a vehicle, a spontaneous formation of mist arising as a result of condensing of water is avoided, since, even before the temperature of the engine exhaust gas which is discharged to the surrounding area falls below the dew point, comparatively pronounced thorough mixing with ambient air and therefore comparatively pronounced dilution of the engine exhaust gas will take place.

In the case of the drive system 10 which is shown in FIG. 1, the decrease in the water vapor quantity contained in the engine exhaust gas takes place upstream of the oxidation unit 20, configured for example as an oxidation catalytic converter, and of the catalytic converter unit 22, configured for example as an SCR catalytic converter. This means that they are loaded with an engine exhaust gas which is mixed with a considerably lower water vapor proportion, which is particularly advantageous with regard to the ageing of catalytic converters of this type. Furthermore, the engine exhaust gas which is introduced into the engine exhaust gas outlet line 18 can be heated again by way of the operation of the engine exhaust gas heating unit 36 in such a way that its temperature corresponds approximately to the temperature, at which it is ejected from the hydrogen combustion engine 12 and which also lies in the region of the operating temperature of the oxidation unit 20 and/or the catalytic converter unit 22. Therefore, the catalytic reactions can proceed reliably and with high efficiency.

Figure 2:
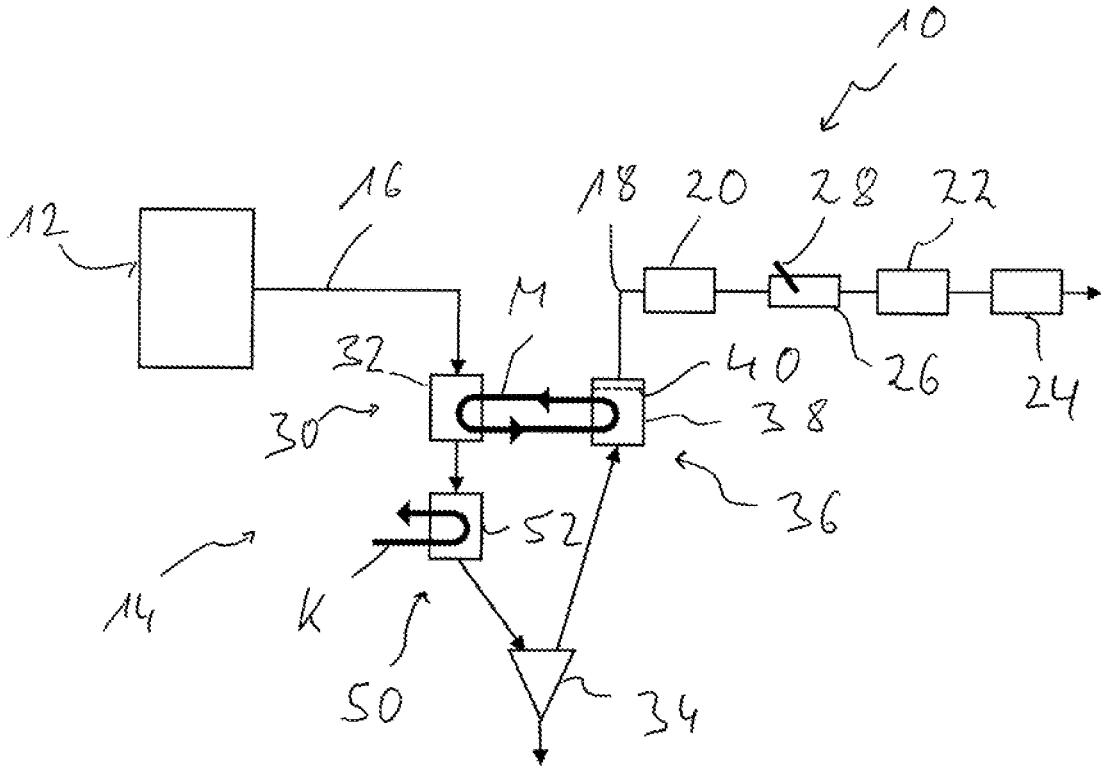
FIG. 2 shows an illustration, corresponding to FIG. 1, of an alternative embodiment of a drive system for a vehicle.

An embodiment of the drive system 10 which is modified, in particular, in the region of the first engine exhaust gas cooling unit 30 and the engine exhaust gas heating unit 36 is illustrated in FIG. 2. In the case of this embodiment, heat is withdrawn in the first engine exhaust gas cooling unit 30, configured as a first heat exchanger 32, from the engine exhaust gas which flows through it, via a heat transfer medium M which is also conducted, in a circuit which is for example closed, through the engine exhaust gas heating unit 36 which is configured as a second heat exchanger 38. Therefore, the engine exhaust gas which flows further downstream in the exhaust gas system 14 can be heated via the engine exhaust gas which flows further upstream in the exhaust gas system 14. As an alternative or in addition, the engine exhaust gas which flows through the engine exhaust gas heating unit 36 can be heated in this engine exhaust gas heating unit 36 by way of a heating medium H and/or an electrically excitable heater 40.

In order for it to be possible to further cool the engine exhaust gas, a second engine exhaust gas cooling unit 50 is arranged downstream of the first engine exhaust gas cooling unit 30. This second engine exhaust gas cooling unit 50 can include, for example, a third heat exchanger 52, in which the engine exhaust gas which has already been cooled in the first engine exhaust gas cooling unit 30 can transfer heat to the cooling medium K. As has already been described in the preceding text, water condenses in the separating unit 34, with the result that engine exhaust gas which has had water vapor removed flows in the direction of the engine exhaust gas heating unit 36 which follows downstream.

Figure 3:
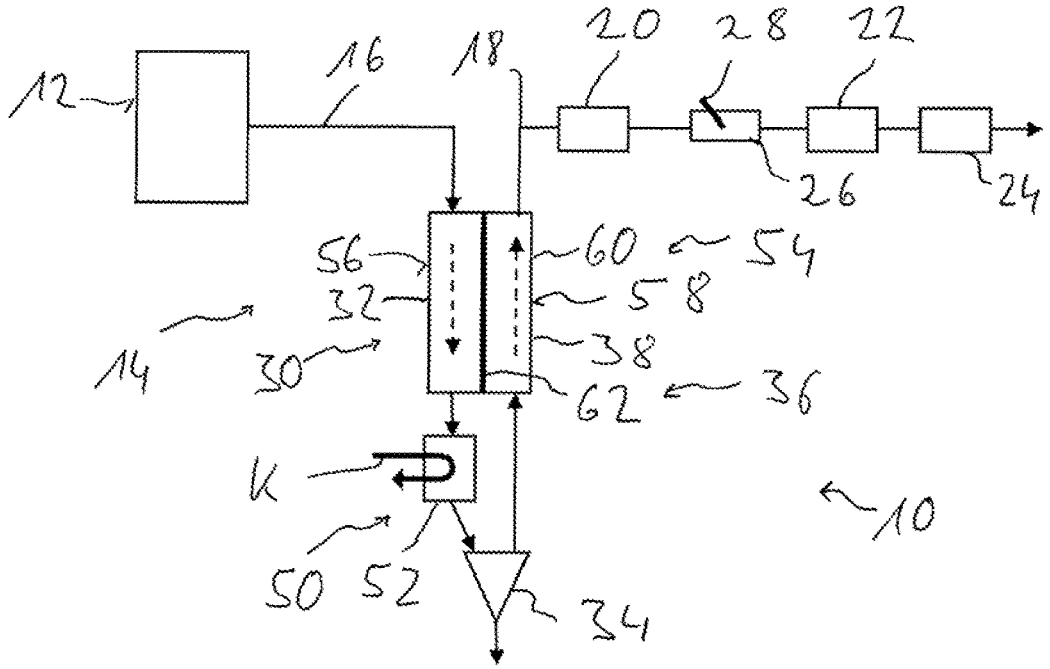
FIG. 3 shows a further illustration, corresponding to FIG. 1, of an alternative embodiment of a drive system for a vehicle.

One variant which is advantageous, above all, with regard to the efficient transfer of heat and the simple structural configuration and in the case of which the heat which is contained in the engine exhaust gas is likewise used to heat a further downstream flowing part of the engine exhaust gas is shown in FIG. 3. In the case of that embodiment of the exhaust gas system 14 which is shown in FIG. 3, a heat exchanger unit which is denoted generally by 54 is provided which is configured as a counter current heat exchanger in the embodiment which is shown. The heat exchanger unit 54 includes an upstream heat exchanger region 56 which provides the first engine exhaust gas cooling unit 30 or the first heat exchanger 32.

Furthermore, the heat exchanger unit 54 includes a downstream heat exchanger region 58 which provides the engine exhaust gas heating unit 36 or the second heat exchanger 38. The two heat exchanger regions 56, 58 can be of channel-like configuration in a heat exchanger unit housing 60 of the heat exchanger unit 54, and can provide flow channels which are separated from one another by way of one or more dividing walls 62 and in which the engine exhaust gas flows substantially in opposed directions and, as a result, transfers heat from that part of the engine exhaust gas which flows through the upstream heat exchanger region 56 to that part of the engine exhaust gas which flows through the second heat exchanger region 58.

It is to be noted that, even in the case of this embodiment, the engine exhaust gas which flows in the engine exhaust gas heating unit 36, that is, in the second heat exchanger region 58, can additionally be heated there by way of a heating medium and/or an electrically excitable heater, as has been described in the preceding text.

The engine exhaust gas which flows through the upstream heat exchanger region 56 and leaves it is conducted to the second engine exhaust gas cooling unit 50 following the upstream heat exchanger region 56 downstream or to the third heat exchanger 52, where it outputs heat to the cooling medium K and is therefore cooled further. In the separating unit 34, the water which condenses from the engine exhaust gas as a result of the further cooling is collected. The engine exhaust gas which has had water vapor removed then flows further to the downstream heat exchanger region 58, where it is heated by way of thermal interaction with the engine exhaust gas flowing in the upstream heat exchanger region 56 and optionally additionally by way of a heating medium and/or an electrically excitable heater.

Figure 4:
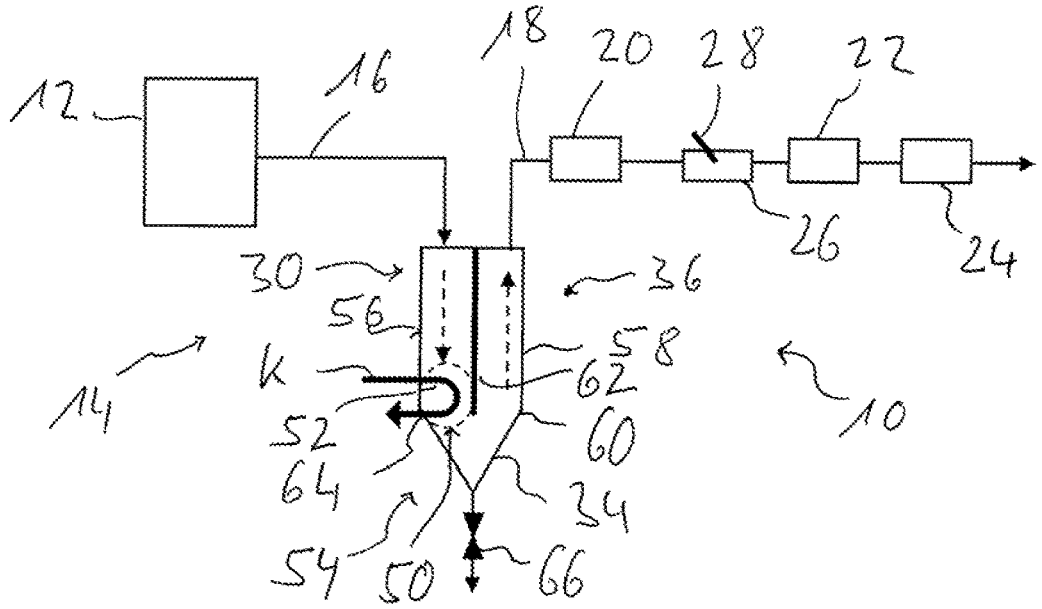
FIG. 4 shows a further illustration, corresponding to FIG. 1, of an alternative embodiment of a drive system for a vehicle.
Figure 5:
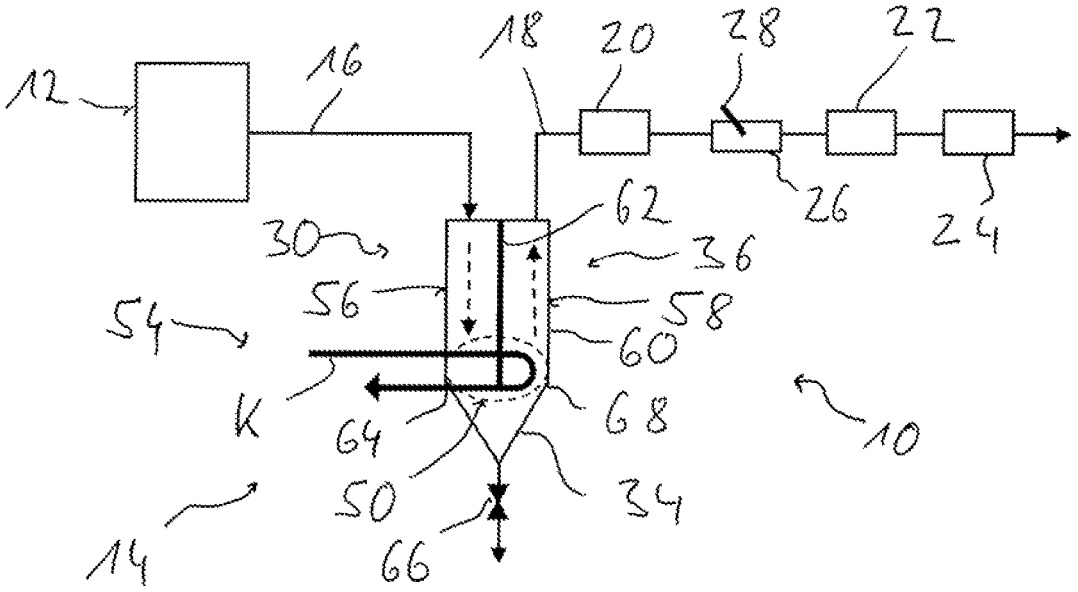
FIG. 5 shows a further illustration, corresponding to FIG. 1, of an alternative embodiment of a drive system for a vehicle.

FIG. 4 shows one configuration variant, in the case of which the second engine exhaust gas cooling unit 50 and the separating unit 34 are combined structurally with the heat exchanger unit 54. As can be seen in FIG. 5, the third heat exchanger 52 of the second engine exhaust gas cooling unit 50 can be integrated into the upstream heat exchanger region 56, in particular a downstream end 64, of the same. At or downstream of this downstream end 64 of the upstream heat exchanger region 56, a transition in flow terms takes place to the separating unit 34 and, from the latter, to the downstream heat exchanger region 58. Water which has collected at the separating unit 34 and therefore also in the heat exchanger unit housing 60 of the heat exchanger unit 54 can be output to the surrounding area, for example, via a shut-off unit 66.

For a highly efficient transfer of heat, the third heat exchanger 52 can have fins which increase the surface area available for thermal interaction with the engine exhaust gas flowing in the upstream heat exchanger region 56.

In the modification, shown in FIG. 5, of the construction principle illustrated in FIG. 4, the second engine exhaust gas cooling unit 50 is integrated both into the upstream heat exchanger region 56, in particular in the region of the downstream end 64 thereof, and into the upstream heat exchanger region 58, in particular an upstream end 68. Therefore, water or water vapor can be condensed by way of cooling of the engine exhaust gas and received or collected in the separating unit 34 in the entire transition region from the upstream heat exchanger region 58, that is, the first engine exhaust gas cooling unit 30, to the downstream heat exchanger region 58, that is, the engine exhaust gas heating unit 36.

The third heat exchanger 52 can also have fins in the case of this embodiment for a highly efficient transfer of heat, which fins increase the surface area available for the thermal interaction with the engine exhaust gas flowing in the upstream heat exchanger region 56. It is to be noted, furthermore, that additional heating of the engine exhaust gas flowing through the downstream heat exchanger region 58 by way of a heating medium and/or an electrically excitable heater can also take place in the case of this embodiment.

Figure 6:
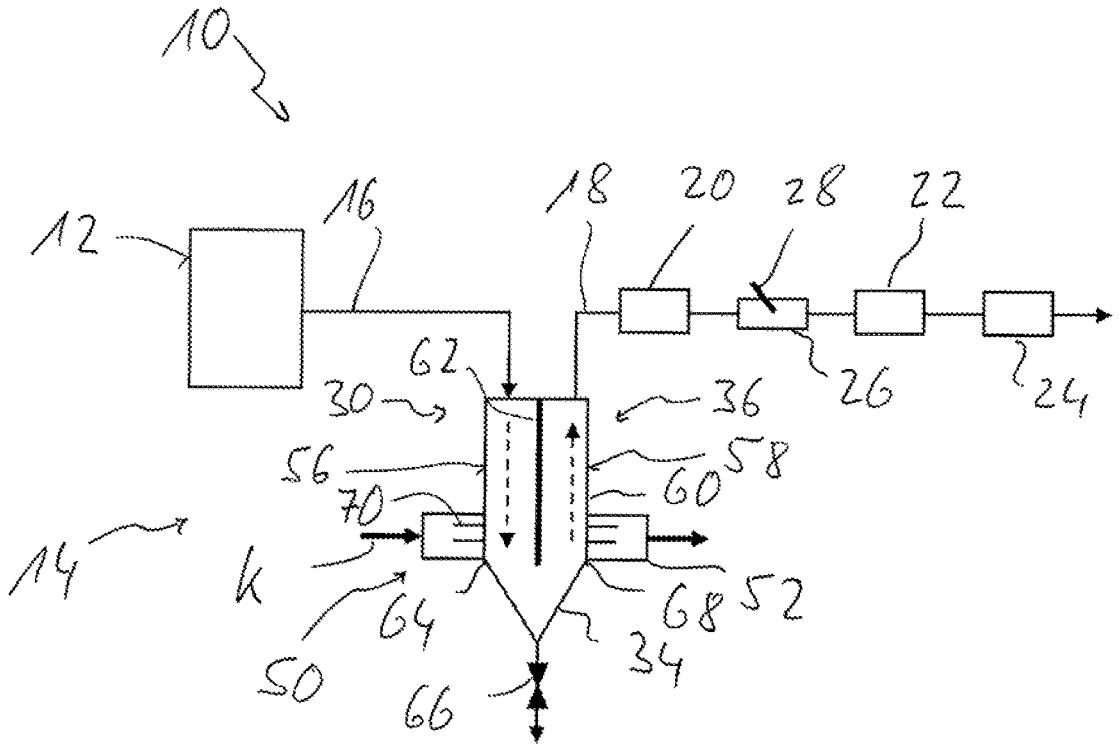

Heat is also removed from the engine exhaust gas at the heat exchanger unit 54 in the case of that configuration variant of an exhaust gas system 14 which is shown in FIG. 6, in the region of the downstream end 64 of the upstream heat exchanger region 56 and in the region of the upstream end 68 of the downstream heat exchanger region 58. For this purpose, the first heat exchanger 32 of the first engine exhaust gas cooling unit 30 surrounds the heat exchanger unit housing 60 of the heat exchanger unit 54 on its outer side, and can be flowed through by the cooling medium K. For boosted thermal interaction and therefore for improved dissipation of heat from the engine exhaust gas flowing through the heat exchanger unit 54, heat transfer fins 70 can be provided on the outer side of the heat exchanger unit housing 60, by way of which heat transfer fins 70 the surface area available for the output of heat to the cooling medium K is increased.

Figure 7:
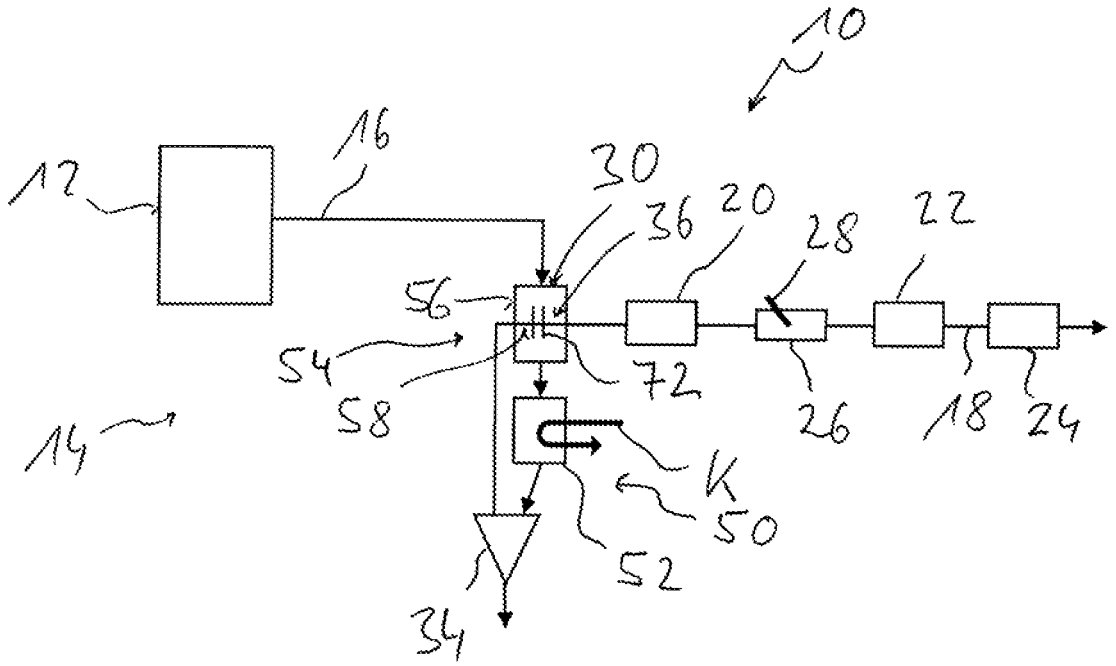
FIG. 7 shows a further illustration, corresponding to FIG. 1, of an alternative embodiment of a drive system for a vehicle.

A further alternative embodiment, in the case of which heat can be transferred in a heat exchanger unit 54 from the engine exhaust gas flowing in a further upstream part of the exhaust gas system 14 to the engine exhaust gas flowing in a further downstream part of the exhaust gas system 14, is illustrated in FIG. 7. In the case of this embodiment, the heat exchanger unit 54 is configured as a cross-flow heat exchanger. A volume which substantially provides the upstream heat exchanger region 56 is formed in the heat exchanger unit housing 60, which volume is flowed through by the engine exhaust gas which is fed in via the first engine exhaust gas line 16. The engine exhaust gas which is conducted through this upstream heat exchanger region 56 then flows through the second engine exhaust gas cooling unit 50 or its third heat exchanger 52, and dissipates heat in the process to the cooling medium K. After flowing through the separating unit 34, the engine exhaust gas which has had water vapor removed then flows through a line region which provides the downstream heat exchanger region 58, runs in the heat exchanger unit housing 60, and on which heat transfer fins 72 can be provided for boosted thermal interaction with the engine exhaust gas flowing through the upstream heat exchanger region 56.

It is also the case in this embodiment that the engine exhaust gas leaves the upstream heat exchanger region 56 or the heat exchanger unit 54 in a heated state, and then flows, for example, to the catalytic converter unit 44' and the muffler 24 before it warms up and is therefore discharged to the surrounding area with a comparatively low relative humidity.

It is also the case in the embodiments shown in FIGS. 6 and 7 that the above-described measures can additionally be assigned to the downstream heat exchanger region 58 for additional heating. Therefore, additional heating of the engine exhaust gas which flows through the downstream heat exchanger region 58 and has had water vapor removed can take place by way of a heating medium and/or an electrically excitable heater.

In the case of all the above-described embodiments, the cooling medium K and/or the heating medium H can, if used, be provided by way of liquids and/or gases, it being possible, in particular, for the cooling medium K to dissipate the heat received therein to the surrounding area in a further heat exchanger. The cooling medium K can also be provided, for example, by way of the ambient air, with the result that the first heat exchanger can include, for example, a plurality of fins which can be flowed around by ambient air. The heating medium H can be heated, for example, during the catalytic processes which proceed in the oxidation unit 20 or the catalytic converter unit 22. As an alternative, instead of or in addition to the oxidation catalytic converter which provides an oxidation unit 20 for oxidizing the residual hydrogen still contained in the engine exhaust gas, a burner can be provided as a further example of an oxidation unit of this type, in which burner the residual hydrogen is burned with oxygen. The oxygen can be provided, for example, by way of air being fed into the engine exhaust gas outlet line 18 upstream of the oxidation unit 20. The heat which is produced during the combustion can be transferred in a heat exchanger assigned to the burner to the heating medium H and from the latter to the engine exhaust gas which flows through the second heat exchanger 38.

In the case of an exhaust gas system which is constructed according to the disclosure, as illustrated, in particular, by the embodiments of FIGS. 3 to 6, structural linking or merging of different system regions can be provided, in particular of the first engine exhaust gas cooling unit, the separating unit and the engine exhaust gas heating unit, possibly also with the second engine exhaust gas cooling unit, with the result that these different system regions adjoin one another directly and/or also overlap one another in flow terms. Thus, water vapor or water can already be separated from the engine exhaust gas via the separating unit in the region of the first engine exhaust gas cooling unit and/or also in the region of the engine exhaust gas heating unit, and can be collected in liquid form, for example.

It is understood that the foregoing description is that of the preferred embodiments of the invention and that various changes and modifications may be made thereto without departing from the spirit and scope of the invention as defined in the appended claims.

The invention claimed is:

1. An exhaust gas system for a hydrogen combustion engine including for a vehicle, the exhaust gas system comprising:

a first engine exhaust gas cooler accommodating a flow of engine exhaust gas therethrough for dissipating heat from the engine exhaust gas, said first engine exhaust gas cooler including a first heat exchanger for transferring heat from the engine exhaust gas to a cooling medium including a cooling liquid or cooling gas;

a separator being configured to separate condensate contained in the engine exhaust gas in a region of said first engine exhaust gas cooler and/or downstream of said first engine exhaust gas cooler; and, an engine exhaust gas heater being configured to warm the engine exhaust gas in a region of said separator and/or downstream of said separator, said engine exhaust gas heater including a second heat exchanger for transferring heat from a heating medium including a heating liquid or heating gas, to the engine exhaust gas;

wherein a heat transfer medium flows through said first heat exchanger and said second heat exchanger to provide said cooling medium and said heating medium.

2. The exhaust gas system of claim 1, wherein the engine exhaust gas heater includes at least one electrically excitable heater.

3. The exhaust gas system of claim 1, further comprising an engine exhaust gas line leading to said first engine exhaust gas cooler.

4. The exhaust gas system of claim 1, further comprising an engine exhaust gas outlet line leading away from said engine exhaust gas heater.

5. The exhaust gas system of claim 4, further comprising at least one of:

i) at least one oxidizer; and, ii) at least one catalytic converter being arranged in said engine exhaust gas outlet line.

6. The exhaust gas system of claim 5, further comprising at least one reactant dispensing arrangement for dispensing reactant into the engine exhaust gas.

7. The exhaust gas system of claim 6, wherein at least one reactant dispensing arrangement is arranged upstream of at least one catalytic converter.

8. The exhaust gas system of claim 4, further comprising: at least one muffler arranged in said engine exhaust gas outlet line leading away from said engine exhaust gas heater.

9. The exhaust gas system of claim 1, further comprising at least one of:

i) an oxidizer including an oxidation catalytic converter;

ii) a burner for oxidizing hydrogen contained in the engine exhaust gas; and, iii) at least one catalytic converter including an SCR catalytic converter for decreasing nitrogen oxide proportions contained in the engine exhaust gas.

10. A drive system for a vehicle, the drive system comprising:

a hydrogen combustion engine; and, an exhaust gas system for said hydrogen combustion engine, said exhaust gas system including:

a first engine exhaust gas cooler accommodating a flow of engine exhaust gas therethrough for dissipating heat from the engine exhaust gas, said first engine exhaust gas cooler including a first heat exchanger for transferring heat from the engine exhaust gas to a cooling medium including a cooling liquid or cooling gas;

a separator being configured to separate condensate contained in the engine exhaust gas in a region of said first engine exhaust gas cooler and/or downstream of said first engine exhaust gas cooler; and, an engine exhaust gas heater being configured to warm the engine exhaust gas in a region of said separator and/or downstream of said separator, said engine exhaust gas heater including a second heat exchanger for transferring heat from a heating medium including a heating liquid or heating gas, to the engine exhaust gas;

wherein a heat transfer medium flows through said first heat exchanger and said second heat exchanger to provide said cooling medium and said heating medium.

11. A method for operating a drive system including a hydrogen combustion engine for a vehicle, the drive system including a first engine exhaust gas cooler accommodating a flow of engine exhaust gas therethrough for dissipating heat from the engine exhaust gas, said first engine exhaust gas cooler including a first heat exchanger for transferring heat from the engine exhaust gas to a cooling medium including a cooling liquid or cooling gas; a separator being configured to separate condensate contained in the engine exhaust gas in a region of said first engine exhaust gas cooler and/or downstream of said first engine exhaust gas cooler; and, an engine exhaust gas heater being configured to warm the engine exhaust gas in a region of said separator and/or downstream of said separator, said engine exhaust gas heater including a second heat exchanger for transferring heat from a heating medium including a heating liquid or heating gas, to the engine exhaust gas, wherein a heat transfer medium flows through said first heat exchanger and said second heat exchanger to provide said cooling medium and said heating medium, the method comprising:

cooling the engine exhaust gas outputted by said hydrogen combustion engine to condense water by the heat transfer medium flowing through the first heat exchanger;

removing water vapor from the engine exhaust gas; and, heating the engine exhaust gas from which water vapor was removed.

12. An exhaust gas system for a hydrogen combustion engine including for a vehicle, the exhaust gas system comprising:

a first engine exhaust gas cooler accommodating a flow of engine exhaust gas therethrough for dissipating heat from the engine exhaust gas, said first engine exhaust gas cooler including a first heat exchanger for transferring heat from the engine exhaust gas to a cooling medium including a cooling liquid or cooling gas;

a separator being configured to separate condensate contained in the engine exhaust gas downstream of said first engine exhaust gas cooler; and, an engine exhaust gas heater being configured to warm the engine exhaust gas in a region of said separator and/or downstream of said separator, said engine exhaust gas heater including a second heat exchanger for transferring heat from a heating medium including a heating liquid or heating gas, to the engine exhaust gas;

wherein a composite heat exchanger provides said first heat exchanger and said second heat exchanger; said composite heat exchanger including an upstream heat exchanger region accommodating the flow of the engine exhaust gas therethrough and a downstream heat exchanger region downstream of said upstream heat exchanger region; and, said downstream heat exchanger region lying in heat transfer interaction with said upstream heat exchanger region.

13. The exhaust gas system of claim 12, wherein said separator is arranged downstream of said upstream heat exchanger region and upstream of said downstream heat exchanger region.

14. The exhaust gas system of claim 12, further comprising a second engine exhaust gas cooler for dissipating heat from the engine exhaust gas and said second engine exhaust gas cooler is arranged in accordance with at least one of:

i) downstream of said upstream heat exchanger region;

ii) at a downstream end of said upstream heat exchanger region and upstream of said downstream heat exchanger region; and, iii) at an upstream end of said downstream heat exchanger region.

15. The exhaust gas system of claim 14, wherein said second engine exhaust gas cooler includes a third heat exchanger for transferring heat from the engine exhaust gas to a cooling medium including a cooling liquid or cooling gas.

16. The exhaust gas system of claim 15, wherein said composite heat exchanger includes a heat exchanger housing; said upstream heat exchanger region and said downstream heat exchanger region are arranged in said heat exchanger housing; and, wherein at least one of the following applies:

i) said third heat exchanger is arranged in said heat exchanger housing; and, ii) said heat exchanger housing is arranged in a surrounding manner on an outer side.

17. The exhaust gas system of claim 12, wherein said composite heat exchanger includes a countercurrent heat exchanger or a cross-flow heat exchanger.

* * * * *